US005086692A

United States Patent [19]

Welch et al.

[11] Patent Number: 5,086,692

[45] Date of Patent: Feb. 11, 1992

[54] AIR HANDLING SYSTEM AND METHOD FOR AN OPERATING ROOM

[76] Inventors: Henry W. Welch, 5332 Riverbriar, Knoxville, Tenn. 37919; Theodore G. Bloomfield, 1140 Buxton Dr., Knoxville, Tenn. 37922

[21] Appl. No.: 627,598

[22] Filed: Dec. 14, 1990

Related U.S. Application Data

[63] Continuation-in-part of Ser. No. 508,860, Apr. 12, 1990, abandoned, which is a continuation-in-part of Ser. No. 280,600, Dec. 6, 1988, abandoned.

[51] Int. Cl.[5] ..... E24F 7/007

[52] U.S. Cl. ..... 454/187; 454/66; 454/190; 454/236

[58] Field of Search ..... 55/385.2; 98/36, 31.5, 98/31.6, 33.1, 39.1, 40.1; 128/847

[56] References Cited

U.S. PATENT DOCUMENTS

| | | | |
|---|---|---|---|
| 2,847,928 | 8/1958 | Glass | 98/106 |
| 3,150,584 | 9/1964 | Allander | 98/39.1 |
| 3,838,556 | 10/1974 | Finger | 98/36 |
| 3,908,155 | 9/1975 | Skinner . | |
| 3,948,155 | 4/1976 | Hedrick | 98/114 X |
| 4,020,752 | 5/1977 | Stephan | 98/114 X |
| 4,598,631 | 7/1986 | Everett | 98/36 |
| 4,781,108 | 11/1988 | Nillson | 98/36 |

FOREIGN PATENT DOCUMENTS

| | | | |
|---|---|---|---|
| 696314 | 10/1964 | Canada | 98/40.1 |
| 61-282742 | 12/1986 | Japan | 98/36 |
| 62-138636 | 6/1987 | Japan | 98/36 |
| 62-190337 | 8/1987 | Japan | 98/36 |

*Primary Examiner*—Harold Joyce

[57] ABSTRACT

An air handling system (10) and associated method for supplying filtered air to an operating room (14) in a manner which reduces concentrations of airborne bacteria and other particulates. The system (10) generally includes a plenum (18) mounted at the top of a first wall portion (22) of the operating room (14). A diffuser (48) is closely received in a diffuser opening (46) through which air is communicated from the air chamber (38) of the plenum to the operating room (14). The diffuser (48) is disposed so as to depend downwardly from a point proximate the ceiling of the operating room and converge toward the first end wall (22). Further, at least one air return (60) is provided at the second and opposite wall portion (54) of the operating room (14) for removing air from the room (14) and returning the air to the clean air supply unit (12). Another but smaller portion of the air is removed through at least one air return at the base of the first wall portion of the room. The method of the present invention includes directing a first current of clean air from a point near the upper corner of the operating room, diagonally across the operating region above the operating table and directing a second current of filtered air from a point proximate the upper corner of the operating room toward and beneath the operating table.

10 Claims, 5 Drawing Sheets

AIR HANDLING SYSTEM AND METHOD FOR AN OPERATING ROOM

This application in part discloses and claims subject matter disclosed in an earlier filed pending application, Ser. No. 07/508,860 filed Apr. 12, 1990 now abandoned, which is a continuation-in-part application of patent application Ser. No. 07/280,600, filed Dec. 6, 1988 now abandoned.

TECHNICAL FIELD

This invention relates to an improved air handling system and method for supplying filtered air to an operating room in a manner which reduces the concentration of airborne particulates including bacteria within the operating room. In this particular invention, the air handling system includes a plenum for communicating air to the operating room, a multi-angled diffuser to produce laminar air flow in two directions through the room and at least one air return through which air is removed from the room.

BACKGROUND ART

It has long been recognized that airborne bacteria and other airborne contaminants in the operating room are a primary cause of post operative infection. This is particularly true with operations which are long in duration and/or where the wound or incision covers a large surface area.

The prefiltering of air supplied to the operating room is insufficient to adequately reduce airborne contaminants, and various systems have been introduced to deliver clean air to an operating room, and remove air from the operating room, in a manner which effectively removes airborne particulates. Such systems generally rely on delivering large quantities of air to the center of the operating room such that air pressure within an operative zone therein, is greater than the pressure outside of the zone, so as to keep contaminants out. In most conventional systems, this prefiltered air is introduced through ducts and registers in the ceiling such that a vertical flow of air is forced downwardly upon the operating table and the operating area surrounding it creating a clean air zone from which contaminants are flushed.

One of the primary sources of airborne contaminants is the surgical team and other persons within the operating room. In this regard, contaminants are entrained into the operating region of the operating room as members of the surgical team move into and out of the operating region. Further, there is a natural tendency for airborne contaminants to rise into the zone above the operating table due to heat from surgical lights and the surgical team. Moreover, contaminants collected on ceiling, floor and wall surfaces and on equipment, subsequently become airborne and a source of infection. Also, such ceiling mounted systems occupy large portions of the ceiling area and generally are mounted in a suspended ceiling having removable ceiling panels such that the system can be accessed for maintenance and repair. Accordingly, ceiling space is lost which could otherwise be used for supporting medical equipment, and the suspended ceilings tend to collect contaminants and are difficult to clean. Moreover, the vertical flow of air is often disrupted by surgical lights and other equipment thereby compromising the clean air zone.

Other air handling systems utilize a horizontal air flow pattern whereby laminar or near-laminar air flow is directed horizontally across the operating room flushing the operating area with clean air. Such horizontal flow systems, when unobstructed, provide an efficient means for sweeping the operating area free of contaminants, but medical equipment can disrupt the flow unless restrictions are placed on equipment placement. Further, substantial amounts of wall space must be dedicated to such systems.

An example of one air handling system which utilizes a diagonal air flow pattern is disclosed in U.S. Pat. No. 3,150,584, issued to C. Allander However, the Allander system creates an air current over a portion of the room which is inadequate for maintaining the entire operating zone or region free of contaminants. Another system which utilizes a diagonal air flow pattern is disclosed in U.S. Pat. No. 4,781,108, issued to Nillson, but the Nillson system utilizes a combination of diagonal and horizontal air currents which intersect. These intersecting air currents result in turbulence which disrupts the desired sweeping action of the air flow through the operating region.

Examples of other air flow handling devices are disclosed in U.S. Letters Pat. Nos. 2,847,928; 3,838,556; 3,908,155; 3,948,155; 4,020,752; and 4,598,631. Also, examples of vertical and horizontal air flow systems are disclosed in "Contamination-Free Environments for the Microelectronics Industry", by Ed Cook, *Microcontamination,* June 1987. Moreover, systems are disclosed in Canadian Patent Number 696,314, and Japanese Patent Numbers 282,742; 138,636; and 190,337. The Japanese '337 patent is similar to that of the U.S. '108 patent except that the only return is on the floor below the inlet on the same side of the room. Thus, there is no diagonal "sweeping" of the room. This system is designed to cover a work table underneath the unit and not the entire room.

Therefore, it is an object of the present invention to provide an improved air handling system and method for supplying HEPA (99.97% of 0.3 microns and larger) filtered air to an operating room in a manner which reduces the concentration of airborne bacteria and contaminants within the operating room.

Another object of the present invention is to provide an improved air handling system which does not occupy large areas of the walls and ceiling of the operating room.

Still another object of the present invention is to provide an air handling system which creates an air flow pattern which has minimum disruption by surgical lights and other equipment within the operating room, and which improves comfort of the surgical staff.

A further object of the present invention is to provide an air handling system for an operating room which produces sufficient unidirectional air flow streams to effectively sweep the entire room.

Yet another object of the present invention is to provide an air handling system which is inexpensive to manufacture and maintain.

It is also an object to provide a system that can be constructed in modules to facilitate the air handling for rooms of different size, etc.

DISCLOSURE OF THE INVENTION

Other objects and advantages will be accomplished by the present invention which provides an air handling system and method for supplying clean air to an operating room in a manner which reduces concentrations of airborne bacteria and other particulates in the operating area and the operating room in general. The system generally comprises a plenum mounted at a first wall of the operating room in the upper corner of the room defined by the intersection of the ceiling and that wall. The plenum defines an air chamber therein connected in fluid communication to the air outlet of an HVAC unit or clean air supply unit, and further defines at least one diffuser opening accessing the air chamber. At least one air diffuser is closely received in the diffuser opening through which air is communicated from the air chamber to the operating room. The diffuser is disposed so as to depend downwardly from a point proximate the ceiling of the operating room and converge toward the first wall. Resultantly, and in accordance with the method of the present invention, the diffuser produces a pair of diagonal and laminar air flow patterns directed downwardly and generally toward the opposite wall of the operating room so as to sweep the entire operating room. Further, at least one air return (most hospital codes require at least two air returns) is provided at the opposite wall of the operating room to achieve the diagonal flow. The air return is connected in fluid communication with the air return inlet of the clean air supply unit and serves to remove air from the operating room such that it can be reprocessed by the clean air supply unit. In the preferred embodiment, a portion (e.g., 20%) of the air is removed at the base of the first wall. It will also be noted that in the preferred embodiments of the system, the diffuser comprises upper and lower diffuser sections disposed at differing angles so as to produce the two preselected radial air flow patterns in the operating room.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
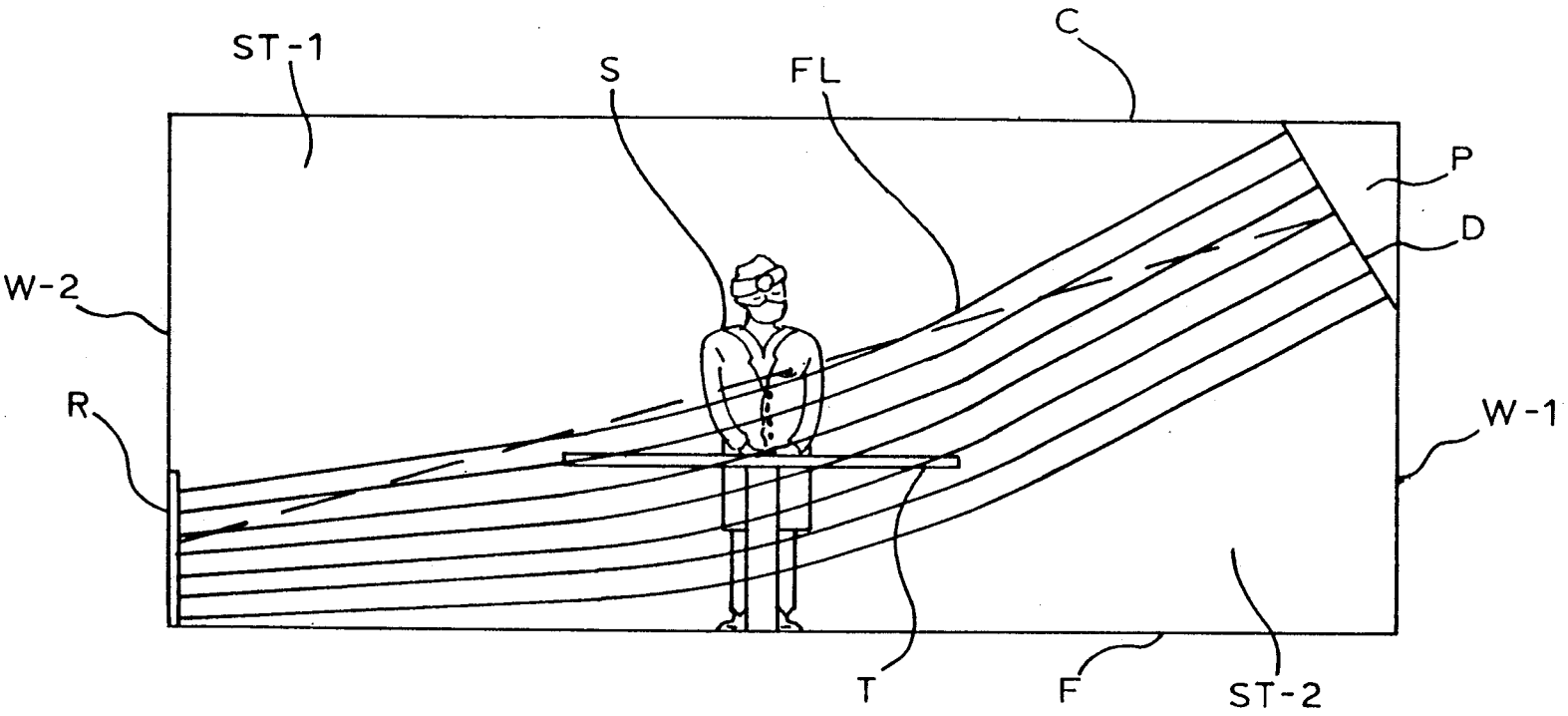
FIG. 1 PRIOR ART
FIG. 1 diagrammatically illustrates an air handling system of the prior art as installed in an operating room depicting the air flow pattern produced by that system showing areas of stagnation.

In order to have a better understanding of the benefits of the present invention, one of the devices of the prior art (U.S. Pat. No. 3,150,584) is depicted in FIG. 1. In one corner at the junction of the ceiling C and a wall W-1 is positioned a diffuser D that is provided with air from a manifold or plenum P. At a level of the floor F, and in the opposite wall W-2, is positioned a return R for withdrawing air from the room. With this arrangement there is created an air flow FL diagonally across the rom which sweeps an operating table T and a surgeon S or other operating personnel. While this system appears to achieve this sweeping action to remove bacteria, etc., there are rather large areas ST-1 and ST-2 of basically stagnant air. Thus, any particulate matter in these areas is not removed from the room such that the room remains partially contaminated. This is in contrast to the system of the present invention, the advantages of which will become apparent upon the following description.

Figure 2:
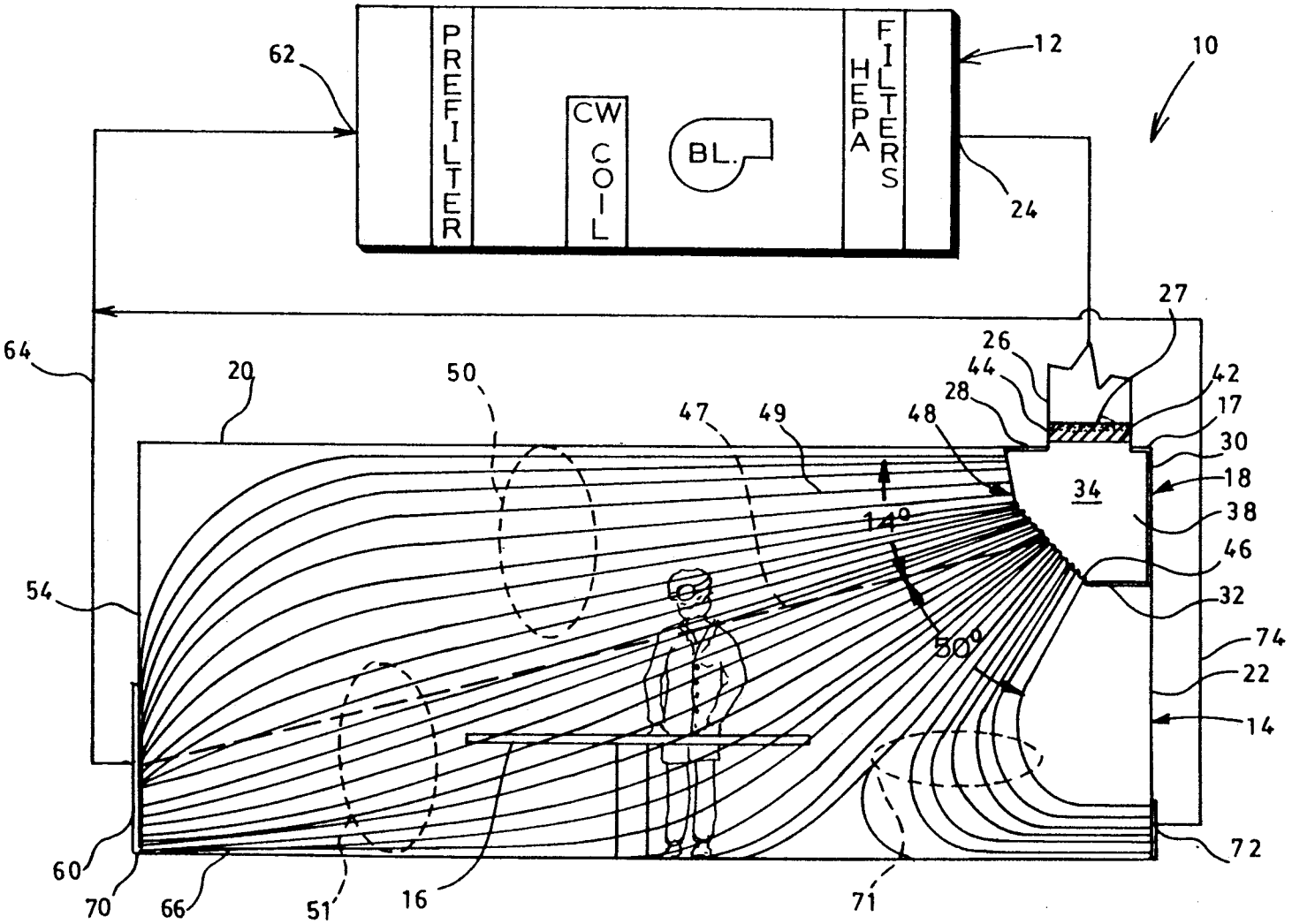
FIG. 2 diagrammatically illustrates an air handling system of the present invention installed in an operating room depicting the effectiveness of the system in completely flushing the air from within the operating room.

An air handling system for an operating room incorporating various features of the present invention is diagrammatically illustrated at 10 in FIG. 2. The air handling system 10 is preferably used in conjunction with a HVAC unit incorporating one or more high efficiency particulate air filters ("HEPA filters") such as the diagrammatically illustrated clean air supply unit 12. The air handling system 10 is designed to deliver filtered air from the air supply unit 12 to the operating room 14 in a manner which reduces concentrations of airborne bacteria and other particulate matter in the proximity of the operating table 16 and the operating room 14 in general.

The air handling system 10 comprises a plenum 18 which is mounted in an upper corner 17 of the operating room 14 proximate the point where the ceiling 20 and end wall 22 intersect. The plenum 18 serves to selectively introduce clean air supplied, under pressure, by the air supply unit 12 into the operating room 14, and, thus, is connected to the air supply outlet 24 of the supply unit 12 with suitable ducting 26. More specifically, the plenum 18 defines an enclosure having an upper wall 28, a rear wall 30, a lower lip portion 32 and opposite end walls 34 such that an air chamber 38 is defined therein (see FIG. 4). The lip 32 can extend into the room a distance sufficient to permit installation of cabinets, etc., 73 (see FIG. 4). It will be noted that when the plenum 18 is secured in place, the upper wall 28 engages or is disposed proximate the ceiling 20 and the rear wall 30 engages or is disposed proximate the end wall 22 of the operating room 14. In the preferred embodiment, insulation 40 (see FIG. 4) is interposed between the upper wall 28 and the ceiling 20, and between the rear wall 30 and the end wall 22 to reduce thermal bridging between the plenum 18 and the operating room walls which might otherwise adversely affect air temperature control.

It will also be noted that the plenum 18 is provided with one or more duct access openings 42 circumscribed by duct collars 44 to facilitate connecting the ducting 26 to the plenum 18. It will, however, be recognized by those skilled in the art that whereas the openings 42 of the preferred illustrated embodiment are provided in the upper wall 28, the duct access openings 42 can be provided in the rear wall 30 if desired. It will also be noted that HEPA filters can be mounted in the openings 42 or in the duct 26 proximate the openings 42 as illustrated at 27 in FIG. 2.

Figure 3:
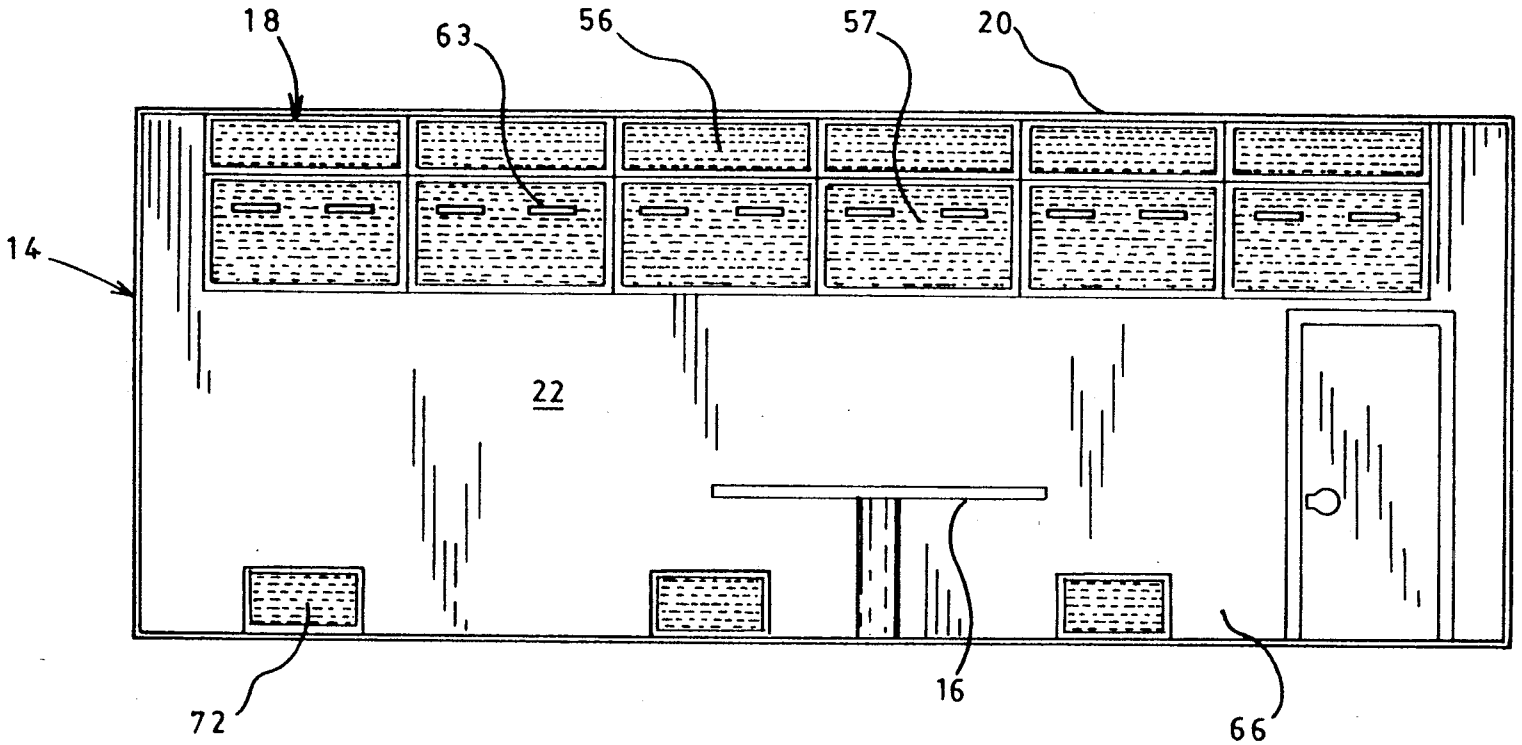
FIG. 3 is a diagrammatic illustration of an elevation of a wall of an operating room with a plenum of the air handling system of the present invention mounted therein.

The plenum 18 is also provided with one or more openings 46 accessing the chamber 38 which closely receive one or more air diffusers 48. More specifically, the air diffusers 48 are mounted in the opening(s) 46 so as to depend downwardly from a point proximate the ceiling 20 and converge toward the end wall 22 of the operating room 14. Thus, as air from the chamber 38 is forced through the diffusers 48, a radial air flow pattern is created as illustrated by the radiating lines 49 in FIG. 2. With respect to the width of the air flow pattern generated, in the preferred embodiment, the plenum 18 extends across a substantial portion of the end wall 22 as illustrated in FIG. 3 such that the operating table 16 and a selected area on either side of the table 16 is swept with clean air from the plenum 18 (see FIG. 2).

Figure 4:
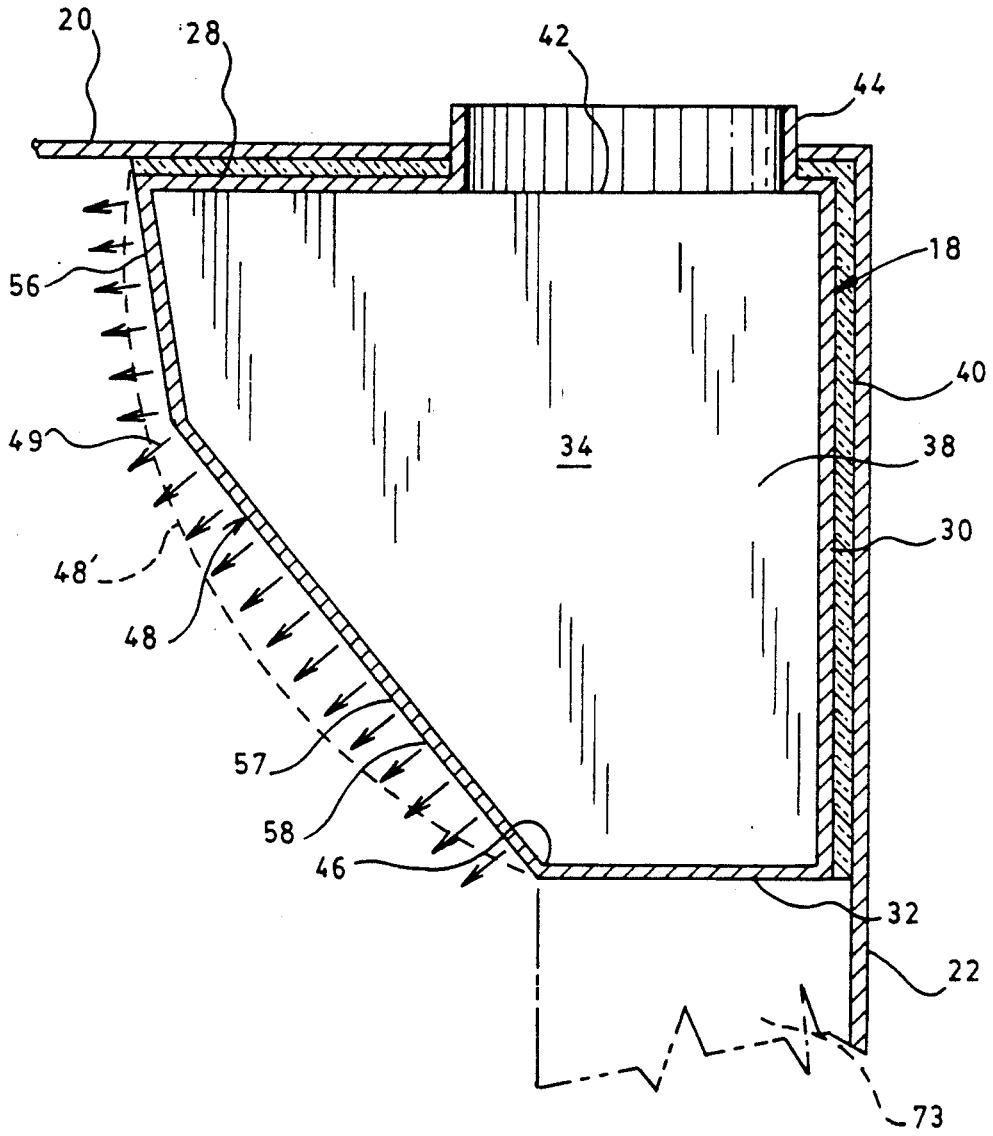
FIG. 4 illustrates a vertical cross-sectional view of a plenum of the air handling system of the present invention as illustrated in FIGS. 2 and 3.

Details of the plenum 18 structure and its installation in a room 14 are shown in FIG. 4. In order to facilitate creation of the desired radial air flow pattern, the diffusers 48 of the preferred embodiment define a plurality of panel sections disposed at differing angles, the angle of the sections being determinative of the direction of the air flow. More specifically, each diffuser 48 defines an upper section 56 and a lower section 57 each of which is diagonally disposed with respect to the end wall 22, but at different angles. In this regard, the upper section 56 is disposed at a preselected angle (typically about 10 degrees with respect to a vertical) which directs the current of clean air emanating from the section 56 on a diagonal path through the operating region generally above the operating table 16 as illustrated by the broken lines 50 in FIG. 2. This clean air flow from the upper section 56 carries off airborne contaminants which tend to rise naturally from the operating table area due to the heat generated by the operating room lights and surgical team, and serves to otherwise sweep the area above the operating table 16. Also, this air stream effectively sweeps particles from even the far side of the room near the ceiling 20.

The bottom section 57 is disposed at a second preselected angle (typically about 40 degrees from the vertical) which directs a second current of clean air, illustrated at 51, diagonally onto the operating table 16 and the general area proximate thereto. This second current of clean air serves to pressurize the area occupied by the operating table, patient and surgical team and to sweep the area of contaminants to reduce entrainment of contaminants immediately over and around the operating table. Accordingly, in accordance with the method of the present invention, the upper and lower sections 56 and 57 of the diffuser 48 cooperatively sweep the operating region of contaminants. However, it will be noted that the differing angular disposition of the sections 56 and 57 creates two separate and distinct air currents with preselected non-converging paths such that a minimum of air stagnation or air turbulence results. The particular angular positions of the upper and lower sections, and their relative widths, provide an angular distribution of air flow 50 above a true diagonal direction 47 of about 14 degrees and an angular direction of about 50 degrees. It will also be noted that the diffusers can be provided with more than two sections if desired or if necessary to achieve the requisite air flow pattern given the configuration of the particular operating room 14. Further, in an alternate embodiment, the diffusers 48 define an arcuate cross-section, as illustrated at 48' in FIG. 4, which facilitates the generation of the radial air flow pattern.

It will be recognized by those skilled in the art that various types of diffusers can be utilized in conjunction with the plenum. However, in the preferred embodiment, the diffuser sections 56, 57 comprise perforated plates, preferably fabricated of stainless steel, having a plurality of selectively spaced holes 58 through which air is forced. Typically these holes are ⅛ inch in diameter and spaced on ¼ inch centers. This construction minimizes aspiration, and results in the generation of a piston-like air pattern which pushes diagonally across the area of the operating table flushing the area with clean air at a preselected temperature. Of course, the size and spacing of the holes 58 can be varied to achieve the desired air supply capacity and characteristics desirable for a specific application. However, preferably the holes 58 are selectively sized to insure that the air pattern and velocity is even across each section 56 and 57 of diffuser 48, and such that a substantially laminar air flow results. In this regard, if the velocity is not even, turbulence can result which would disrupt the desired air pattern. Further, the diffusers are preferably removable to facilitate cleaning and maintenance of the plenum 18. For example, grooves can be provided in the upper wall 28 and lower lip portion 32 to releasably hold the diffusers 48, and handles 63 can be provided on the diffusers (see FIG. 3) to facilitate their removal.

Referring again to FIG. 2, the air handling system 10 also comprises air return means for removing air from the operating room 14 such that it can be returned to the air supply unit 12 for conditioning and filtering. The air return means includes at least one air return 60 connected in fluid communication to the air supply inlet 62 of the air supply unit 12 with the ducting 64. The air return 60 is preferably positioned at the opposite end portion 54 of the room 14 proximate the point 70 at which the floor 66 and opposite end wall 54 intersect. Thus, a major portion of the air introduced at the upper corner 17 by the plenum 18 is removed from the room at the opposite lower corner 70 facilitating the diagonal air flow pattern with an air sweep by air currents 50 of space near the ceiling 20 and by air currents 51 of space at and below the operating table 16. Of course, it will be recognized that a plurality of air returns 60 can be provided along that opposite end portion 54 to insure that the desired return capacity is achieved as using the plenum units shown in FIG. 3.

Although the system described above provides an excellent sweep of the upper and central portions of the room 14, some stagnation is found in the room below the plenum structure 18 unless at least one further return 72 is provided in the wall 22 beneath the lip 32. This produces an air stream, from air discharged through diffuser portion 57, as indicated with the dashed line designated with the numeral 71. Of course, it will be understood that there can be more than one such return 72 along this wall (see FIG. 3). Air withdrawn through this return 72 enters ducting 74 for return to the air supply unit 12 at air inlet 62. Typically, about 20% of the total air input is withdrawn through this return 72 so as to properly sweep air through this lower portion of the room 14 to achieve optimum removal of particulates. If cabinets are to be installed under the lip 32 of the plenum 18, as suggested in FIG. 4, the return 72 can be placed so that the cabinets do not interfere with the air flow.

Figure 5:
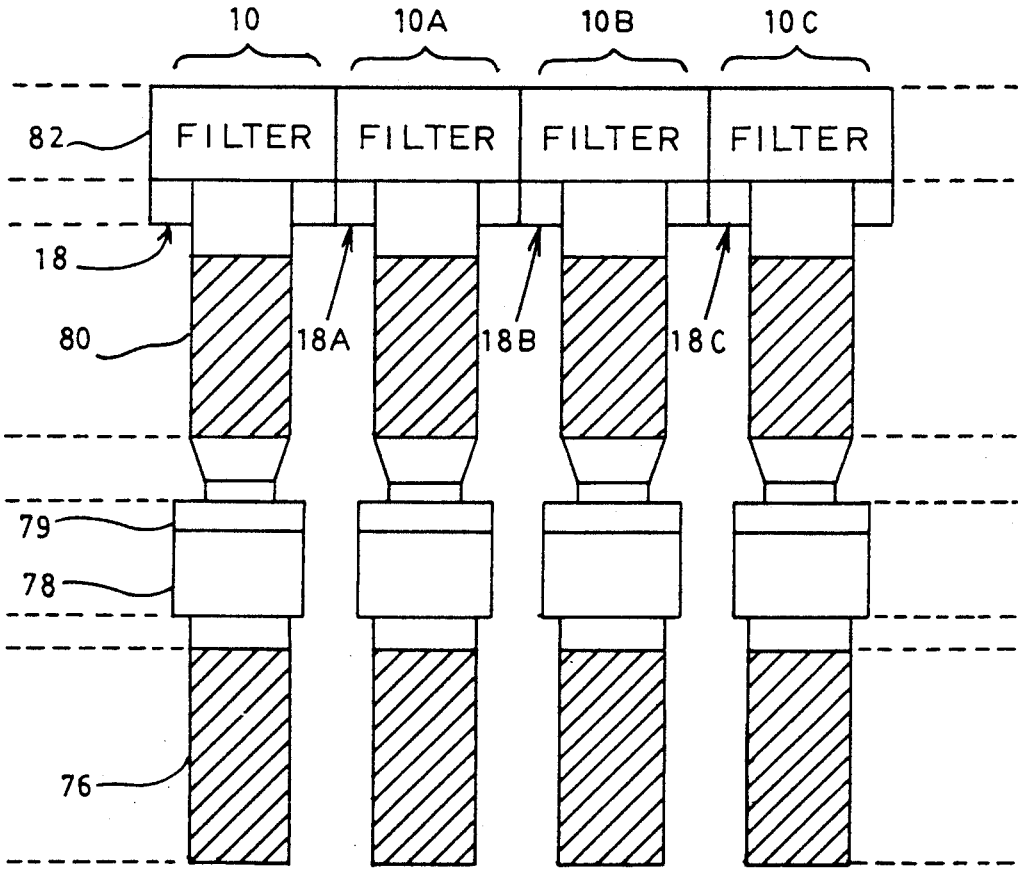
FIG. 5 illustrates a top plan view of a group of modular units that embody the air handling system of the present invention.

A discussion of FIG. 2 implies that a single air system 12 Can be used to direct air into a plenum 18, which is true. However, when the plenum 18 is made up of several sections such as illustrated in FIG. 3, an air system may have insufficient capacity. Further, since total air capacities may differ in one room from another room, the one air system concept may be impractical. In contrast, illustrated in FIG. 5 is a modular concept of the present invention wherein any needed number of modules 10, 10A, 10B, 10C, etc., can be installed in a room to achieve the desired air flow. Air is typically supplied to each through a sound attenuator 76 such as that available from Industrial Acoustics Company. A conventional booster fan 78 forces this air through another sound attenuator 80 and thence through typical filters 82 (such as the HEPA filters of FIG. 2). Air from the individual filters 82 then enters the individual plenum portions 18, 18A, 18B, 18C., etc. In addition, there is typically an air tempering unit 79 located on either side of the fan to regulate air temperature and/or humidity. This module construction not only permits providing the total air flow needed for a specific room, but it also permits standardized construction yet permits the selecting of air flow for a particular portion of the room.

To the best of the applicants' knowledge, there are no required standards for ultra clean air in operating suites in the United States However, there are standards published by the U.S. Federal Government which include Federal Standard 209C designed for application to clean rooms. References are made to this as well as to other relevant United States standards. Other countries do have specific standards for hospital operating rooms; therefore, their standards are used as a comparison for test results using the present invention. Available references for standards are:

1. The U.S. Health, Education and Welfare Department, DHHS Publication HRSA84-14500, 1984.
2. "The U.S. Federal Standard 209C for Clean Rooms", U.S. EPA, 1987.
3. "Ventilation of Operating Departments", UK Department of Health and Social Security, Ref. DV4.1, Feb. 1983.
4. "Ventilation in Operating Suites", Report of a Joint Working Party, UK DHSS, June 1972.

The air particle count in operating rooms with normal distribution systems can range from 150,000 to 400,000 particles of 0.3 microns and larger per cubic foot. Using the above standards as reference, recommendations were made by Healthy Buildings International, an independent testing company located in Fairfax, VA with additional offices in Australia and Canada, that the operating room have less than 2,000 particles of 0.3 microns and larger per cubic foot present at a steady state condition, and less than 20,000 particles of 0.3 microns per cubic foot during use of the room for surgery. The microbial counts should be less than 35 colony forming units (cfu) per cubic meter of sampled air.

In March of 1990, a test was conducted on the air handling system for operating rooms as described herein in connection with FIGS. 2–4. The test was conducted in both an unoccupied steady state condition and during an actual heart surgery procedure. The test was conducted on behalf of the applicants by Healthy Buildings International (HBI). The testing addressed air particle count, temperature, relative humidity and airborne microbial counts in the operating room. Results of the testing were provided to the applicants, after completion of the tests in a HBI report.

Included herein, as Table I, is a summary of the measurement of air particle counts. The airborne particle counter used was a RION status 5000 model which is a light scattering counting type over a range of 0.3 to 5 microns. These data appeared on pages 10–12 of the above-referenced HBI report. Measurements near the table with the room in steady state condition ranged from 200 to 800 particles per cubic foot of 0.3 microns and larger. This will be noted as being well below the recommendation of 2,000 particles. During the surgery procedure, the air particle count ranged from 700 to 2,800 particles per cubic foot except when the drapes were shaken out or the laser knife was in use. During these procedures, the count rose to approximately 50,000 particles per cubic foot but was reduced to less than 2,000 within 5 minutes. This is significantly below the 20,000 recommended range for surgical procedures.

Airborne and surface microbial levels were also measured both during a steady state and during a surgical procedure. The airborne microbial levels were made using a centrifugal air sampler (Biotest Diagnostics, Frankfort, West Germany) employing an impaction onto a Agar strip lining a drum. Surface samples for bacteria and fungi were taken using contact Agar sampling plates containing Letheen Agar or Sabouraud's dextrose Agar followed by incubation and identification. Table II (pages 25 and 26 of the test report) are included which summarize the microbial counts. As can be seen, the microbial count (cfu) is significantly below the standard of 35.

TABLE I

| | | Measurement of Airborne Particles | |
|---|---|---|---|
| Time | Location | Airborne Particle Counts | Comments |
| 0300 | OR#2: Position $X_1$ | 1400; 1600; 1400; 1300; 1600 | Start-up |
| 0310 | | 1100; 1400; 1100; 1200; 1100 | |
| 0320 | | 1000; 1200; 1100; 1200; 1100 | |
| 0330 | | 1200; 1200; 1100; 1300; 1300 | |
| 0340 | | 1400; 1400; 1200; 1200; 1400 | |
| 0350 | | 1000; 1000; 1000; 1100; 1100 | |
| 0400 | | 2600; 2400; 1800; 1400; 1000 | |
| 0410 | | 1200; 1500; 1200; 1300; 1200 | |
| 0420 | | 1400; 1400; 1300; 1200; 1100 | |
| 0430 | | 1100; 1200; 1200; 1100; 1100 | |
| 0440 | | 1200; 1300; 1200; 1300; 1200 | |
| 0450 | | 1100; 1200; 1400; 1200; 1100 | |
| 0500 | Position $X_2$ | 400; 300; 100; 100; 200 | Beside operating table |
| 0510 | | 300; 400; 100; 100; 100 | |
| 0520 | Position $T_1$ | 1300; 1200; 1400 | Traverse across room level with table |
| 0525 | Position $T_2$ | 800; 800; 900 | |
| 0530 | Position $T_3$ | 400; 300; 400 | |
| 0535 | Position $T_4$ | 300; 200; 100 | |
| 0540 | Position $T_5$ | 200; 300; 200 | |
| 0550 | Position $T_6$ | 400; 600; 400 | |
| 0600 | Position $T_7$ | 1100; 1100; 1200 | |
| 0605 | Position $T_8$ | 1200; 1400; 1200 | |
| 0610 | OR#1: Position $Y_1$ | 900; 800; 800; 900; 800 | Activity in room |
| 0620 | | 600; 700; 600; 700; 600 | |
| 0630 | | 600; 800; 600; 600; 600 | |
| 0640 | Position $Y_2$ | 400; 300; 300; 400; 300 | |

TABLE I-continued

| Time | Location | Measurement of Airborne Particles: Airborne Particle Counts | Comments |
|---|---|---|---|
| 0650 | | 300; 300; 400; 300; 300 | |
| 0700 | | 300; 200; 300; 200; 200 | |
| 0710–0900 | discontinued counts | | |
| 0900 | OR#1: Position Y2 | 400; 600; 400; 300; 300 | Re-start counts |
| 90910 | | 500; 400; 300; 200; 400 | |
| 0915 | | 700; 900; 900; 1200; 1100 | Staff preparing for op |
| 0920 | | 2400; 800; 1100; 1000; 1100 | |
| 0930 | | 900; 700; 700; 800; 700 | |
| 0940 | | 1000; 2800; 2600; 1800; 1000 | X-ray machine in |
| 0943 | | 7100; 8500; 6600; 3700; 2100 | |
| 0950 | | 9400; 6300; 6900; 3300; 2300 | |
| 0955 | | 3500; 4300; 3800; 2200; 1300 | |
| 1000 | | 8700; 14000; 21500; 15100; 40500 | Drapes being shaken out |
| 1005 | | 31700; 17400; 8400; 4300; 5300 | |
| 1010 | | 5000; 4200; 6500; 50500; 49500 | "smoke" from laser knife |
| 1015 | | 8000; 2900; 3300; 1700; 900 | |
| 1020 | | 4100; 2500; 1400; 2300; 2100 | All doors closed |
| 1025 | | 3100; 3000; 2900; 2600; 1400 | |
| 1030 | | 1800; 2200; 2100; 2000; 2000 | |
| 1035 | | 1600; 1500; 1300; 800; 700 | 0.5 micron counts |
| 1040 | | 700; 600; 800; 800; 600 | |
| 1045 | | 2200; 2500; 2200; 2600; 2700 | |
| 1050 | | 2200; 2600; 2700; 2700; 2700 | |
| 1055 | | 1900; 1300; 10700; 16300; 22500 | |
| 1100 | | 1120; 6300; 1200; 1100; 1000 | |
| 1102 | | 14700; 11200; 11000; 10900; 8600 | Activity in room |
| 1105 | | 12400; 4000; 2300; 1600; 1700 | |
| 1110 | | 1600; 1200; 800; 500; 500 | |
| 1115 | | 400; 300; 300; 400; 300 | |
| 1120 | | 400; 600; 400; 300; 500 | |
| 1125 | | 300; 600; 600; 700; 600 | |
| 1130 | | 500; 400; 600; 400; 400 | |

CONCLUSIONS

These airborne particle counts made in the two OR's fall within the recommended acceptable levels both when the OR's were unoccupied and when surgery was being carried out. It should be remembered that the counts were made in front of one of the main return air grilles which should potentially reflect the highest counts likely to be found in the rooms. It was noticeable that when the counts were increased, as when a burst of particle shedding activity took place such as spreading the drapes, within a minute or two of the cessation of that activity the particle counts dropped back to the previous levels.

It should be pointed out that the air supply system was designed to operate at maximum efficiency with all the OR doors closed. At serveral stages of the operation in OR #1 the doors were left open for long periods at a time and when they were all closed the airborne particle counts immediately dropped.

Notes:

All counts are of 0.3 microns and larger particles except those indicated as 0.5 microns and larger on page 2 of Table I. Positions refer to locations in the OR's.

In summary, the test results indicate that the system does perform as suggested to significantly reduce the room particle count for 0.3 micron size and larger, and that the microbial count stayed well below the recommended levels of 35. Although only the results of air particle counts and microbial counts are reported herein, this is because it is in these areas that the present invention particularly demonstrates improvements over prior art air handling systems. While the test results were achieved at the test site under the conditions described, it is not and cannot be guaranteed that the exact results will be achieved in future installations. It is assumed, however, that similar results would be achieved under similar testing conditions.

TABLE II

Microbiological Testing of Internal Surfaces and Counting of Airborne Microbes

| Sample No. | Location | Microbiological Testing of Internal Surfaces: Number of colonies found per plate: Bacterial | cfu | Fungal | cfu |
|---|---|---|---|---|---|
| | | Operating Room #2 | | | |
| 1 | Operating Table | nil | 0 | nil | 0 |
| 2 | Air supply grille | nil | 0 | nil | 0 |
| 3 | Return Air grille | micrococci sp. | 11 | nil | 0 |
| 4 | Floor near main door | nil | 0 | nil | 0 |
| 5 | Side table | nil | 0 | nil | 0 |
| | | Operating Room #1 | | | |
| 6 | Operating Table | nil | 0 | nil | 0 |
| 7 | Air supply grille | micrococci sp. | 1 | nil | 0 |
| 8 | Return air grille | bacillus sp. | 1 | Penicillium sp. | 1 |
| | | micrococcus sp. | 14 | | |
| | | diphtheroid sp. | 1 | | |
| 9 | Floor near main door | micrococci sp. | 1 | *Mycelia sterilia* | 1 |
| 10 | Side table Room 2470 | diphtheroid sp. | 1 | nil | 0 |

CONCLUSIONS

The above samples show very low numbers of both bacteria and fungi and confirm that the surfaces within the operating rooms are clean and free from microbial contamination.

TABLE II-continued

Microbiological Testing of Internal Surfaces and Counting of Airborne Microbes

| Sample No. | Location | Counting of airborne microbes: Number of colonies found per plate: Bacterial | cfu | Fungal | cfu |
|---|---|---|---|---|---|
| | | Operating Room #2 | | | |
| 1 | At OR table | nil | 0 | nil | 0 |
| 2 | At return air grille (right) | nil | 0 | nil | 0 |
| 3 | At return air grille (left) | nil | 0 | nil | 0 |
| 4 | At air supply grille (right) | nil | 0 | nil | 0 |
| | | Operating Room #1 | | | |
| 5 | At OR table | nil | 0 | nil | 0 |
| 6 | At Return grille (right) | micrococci sp. | 6 | nil | 0 |
| 7 | At Return grille (left) | micrococci sp. | 1 | nil | 0 |
| 8 | At air supply grille | micrococci sp. | 3 | nil | |
| 9 | At rear of room | micrococci sp. | 1 | nil | 0 |
| | | During Operation | | | |
| 10 | At Return grille (r) 0950 hrs | micrococci sp. | 1 | nil | 0 |
| 11 | At Return grille (r) 1020 hrs | nil | 0 | nil | 0 |
| 12 | At Return grille (r) 1050 hrs | nil | 0 | nil | 0 |
| 13 | At Return grille (r) 1100 hrs | nil | 0 | nil | 0 |
| 14 | At Return grille (r) 1120 hrs | nil | 0 | nil | 0 |

CONCLUSIONS

These airborne microbial counts are well below the recommended upper acceptable level of 35 colony forming units per cubic meter of air, both when the rooms were at rest and when an operation was in progress, and are therefore very satisfactory.

In light of the above, it will be appreciated that the air handling system 10 of the present invention provides great advantages over the prior art. The plenum 18 introduces large quantities of air in generally diagonally directed air flow patterns which flush contaminated air from the operating area. The particulate matter driven away from the operative site is then drawn out of the operating room on the opposite end of the room through the returns 60 and through returns 72 at the near end. Unlike systems generating vertical or horizontal laminar or near laminar flow, the system of the present invention is less susceptible to disruption of flow due to placement of operating room equipment. For example, the system 10 provides a flow of air between, and uninterrupted by, the surgical lighting and operating table, and which bathes the surgical team so as to carry contaminants away from the operative site. Moreover, valuable ceiling space or wall space need not be dedicated to the air handling system, and, since the system is not mounted in the ceiling, the ceiling can define a solid surface rather than the suspended, removable tile construction normally used in operating rooms. This solid surface is more easily cleaned and, thus, less likely to collect contaminants which could become airborne. Also, whereas with removable ceiling panels, contaminants can infiltrate into the operating room from above the ceiling, the solid surface reduces or obviates the possibility of contaminants entering the room from above the ceiling.

While a preferred embodiment has been shown and described, it will be understood that there is no intent to limit the invention to such disclosure, but, rather, it is intended to cover all modifications and alternate constructions falling within the spirit and scope of the invention as defined in the appended claims and their equivalents.

We claim:

1. An air handling system for supplying filtered air to an operating room having an operating region where surgical procedures are performed so as to reduce airborne contaminants and improve comfort within said operating region, said operating region being provided with an operating table, said operating room including a first wall, an opposite wall, and having a ceiling and a floor, said operating room also having a upper corner defined by the intersection of said ceiling and said first wall, said air handling system being used in conjunction with an air supply unit provided with an air outlet and an air return inlet, said air handling system comprising:

a plenum mounted at said upper corner of said operating room, said plenum defining an air chamber therein connected in fluid communication to said air outlet of said air supply unit whereby air, under pressure, is supplied to said air chamber, said plenum further defining at least one diffuser opening accessing said chamber to said operating room;

at least one air diffuser for communicating said air within said air chamber to said operating room, said air diffuser being closely received in said diffuser opening and disposed therein so as to depend downwardly from a point proximate said ceiling and converge with said first wall, said diffuser including an upper section and a lower section, said upper section being disposed at a first preselected angle for directing air flow emanating from said upper section in a first stream diagonally through said operating region above said operating table, said lower section being disposed at a second preselected angle for directing air flow emanating from said lower section in a second stream diagonally through said operating region toward said operating table;

at least one air return connected in fluid communication with said air return inlet of said air supply unit for removing a major portion of air from said operating room, said air return being disposed in said opposite wall proximate said floor of said operating room; and at least one further air return connected in fluid communication with said air return inlet of said air supply unit for removing a minor portion of air from said operating room, said further air return disposed in said first wall proximate said floor of said operating room.

2. The air handling system of claim 1 wherein said plenum includes an enclosure having an upper wall, a rear wall, a lower lip portion, and oppositely disposed end walls, and wherein said upper wall is provided with at least one duct opening circumscribed by a duct collar for facilitating the connection of said plenum to said outlet of said air supply unit.

3. The air handling system of claim 1 wherein said upper and lower sections define perforated plates provided with selectively spaced and sized holes through which air is communicated from said air chamber of said plenum into said operating room whereby each said panel produces substantially laminar air flow in said first and second streams diagonally across said operating region.

4. The air handling system of claim 1 wherein said plenum extends across a substantial portion of the width of said first wall so as to provide air to said operating region.

5. The air handling system of claim 1 wherein said air return removes about 80% of said air from said operating room, and wherein said further air return removes about 20% of said air from said operating room.

6. The air handling system of claim 1 wherein said first preselected angle of said upper section of said diffuser is selected to direct said first stream in an angular distribution of about fourteen degrees above a diagonal line joining a center of said air diffuser and a center of said air return, and said second preselected angle of said lower section of said diffuser is selected to direct said second stream in an angular distribution of about fifty degrees below said diagonal line.

7. The air handling system of claim 6 wherein said first preselected angle of said upper section of said diffuser is about 10 degrees from vertical, and said second preselected angle of said lower section of said diffuser is about 33 degrees.

8. An air handling system for supplying filtered air to an operating room having an operating region where surgical procedures are performed so as to reduce airborne contaminants and improve comfort within said operating region, said operating room having a first wall, an opposite wall, a ceiling, and a floor, said operating room having an upper corner defined by the intersection of said ceiling and said first wall, said air handling system comprising:

at least one air supply unit having an air input and an air output;

at least one plenum mounted at said upper corner of said operating room, said plenum defining an air chamber therein connected in fluid communication to said air outlet of said air supply unit whereby air is supplied to said air chamber, said plenum defining at least one diffuser opening accessing said air chamber to said operating room;

an air diffuser closely received in said diffuser opening of said plenum, said air diffuser including an upper section and a lower section, said upper section being disposed so as to depend downwardly from proximate said ceiling and converge toward said first wall at a first preselected angle for directing air flow emanating from said upper section in a first stream having an angular distribution of about fourteen degrees above a diagonal line from a center of said diffuser to proximate a junction of said opposite wall and said floor diagonally through said operating region above said operating table, said lower section being disposed so as to depend downwardly from said first section and converge toward said first wall at a second preselected angle for directing air flow emanating from said lower section in a second stream having an angular distribution of about fifty degrees below said diagonal line diagonally through said operating region toward said table;

at least one air return connected in fluid communication with said air return inlet of said air supply unit for removing about eighty percent of air from said operating room, said air return being disposed in said opposite wall proximate said floor of said operating room; and at least one further air return connected in fluid communication with said air return inlet of said air supply unit for removing about twenty percent of air from said operating room, said further air return disposed in said first wall proximate said floor of said operating room.

9. The air handling system of claim 8 wherein said system has a plurality of modules mounted in parallel within said operating room, each module comprising:

an air supply unit having an air input and an air output;

a plenum mounted at said upper corner of said operating room, said plenum defining an air chamber therein connected in fluid communication to said air outlet of said air supply unit whereby air is supplied to said air chamber, said plenum defining at least one diffuser opening accessing said air chamber to said operating room;

an air diffuser closely received in said diffuser opening of said plenum, said air diffuser including an upper section and a lower section, said upper section being disposed so as to depend downwardly from proximate said ceiling and converge toward said first wall at a first preselected angle for directing air flow emanating from said upper section in a first stream having an angular distribution of about fourteen degrees above a diagonal line from a center of said diffuser to proximate a junction of said opposite wall and said floor diagonally through said operating region above said operating table, said lower section being disposed so as to depend downwardly from said first section and converge toward said first wall at a second preselected angle for directing air flow emanating from said lower section in a second stream having an angular distribution of about fifty degrees below said diagonal line diagonally through said operating region toward said table;

an air return connected in fluid communication with said air return inlet of said air supply unit for removing about eighty percent of air from said operating room, said air return being disposed in said opposite wall proximate said floor of said operating room; and a further air return connected in fluid communication with said air return inlet of said air supply unit for removing about twenty percent of air from said operating room, said further air return disposed in said first wall proximate said floor of said operating room.

10. The air handling system of claim 9 wherein each air supply unit comprises:

an inlet noise attenuator means for receiving air from said air inlet;

a blower fan means to receive air from said inlet noise attenuator means and to cause circulation of air through said air handling system;

an outlet noise attenuator means for receiving air from said blower fan means; and filter means for receiving air from said outlet noise attenuator means and directing said air from said air outlet to said plenum of said air handling system.

* * * * *